US009032765B2

(12) United States Patent
Boesel et al.

(10) Patent No.: US 9,032,765 B2
(45) **Date of Patent: *May 19, 2015**

(54) HASP SEAL LOCK ASSEMBLY

(75) Inventors: Lucas Boesel, Muskago, WI (US); Joshua Miller, Milwaukee, WI (US); Jay Yaeso, Suamico, WI (US)

(73) Assignee: VSI, LLC, Green Bay, WI (US)

( * ) Notice: Subject to any disclaimer, the term of this patent is extended or adjusted under 35 U.S.C. 154(b) by 277 days.

This patent is subject to a terminal disclaimer.

(21) Appl. No.: 13/383,680

(22) PCT Filed: May 11, 2011

(86) PCT No.: PCT/US2011/036098

§ 371 (c)(1), (2), (4) Date: Jan. 12, 2012

(87) PCT Pub. No.: WO2011/143330

PCT Pub. Date: Nov. 17, 2011

(65) Prior Publication Data

US 2012/0103030 A1 May 3, 2012

Related U.S. Application Data

(60) Provisional application No. 61/333,810, filed on May 12, 2010.

(51) Int. Cl.

| | |
|---|---|
| ***E05B 67/38*** | (2006.01) |
| ***E05B 83/10*** | (2014.01) |
| ***E05B 13/00*** | (2006.01) |
| ***G09F 3/03*** | (2006.01) |

(52) U.S. Cl.

CPC ..... *E05B 83/10* (2013.01); *E05B 13/002* (2013.01); *E05B 67/383* (2013.01); *G09F 3/0317* (2013.01)

(58) Field of Classification Search

USPC ..... 70/2, 54, 56, 159, 417; 292/148, 281, 292/285, 286

See application file for complete search history.

(56) References Cited

U.S. PATENT DOCUMENTS

| | | | | | |
|---|---|---|---|---|---|
| 3,140,344 | A | * | 7/1964 | Slater et al. | 174/67 |
| 3,563,069 | A | * | 2/1971 | Ferrer | 70/129 |
| 4,033,156 | A | * | 7/1977 | Cottingham | 70/56 |
| 4,437,692 | A | * | 3/1984 | Halopoff | 70/56 |
| 4,926,662 | A | * | 5/1990 | Gaudet | 70/56 |
| 5,118,149 | A | * | 6/1992 | Emmons | 70/56 |
| 5,271,649 | A | * | 12/1993 | Gromotka | 292/113 |
| 5,307,653 | A | * | 5/1994 | Davis | 70/56 |
| 5,975,595 | A | * | 11/1999 | Lorenzo | 292/205 |
| 6,010,166 | A | * | 1/2000 | Hamilton et al. | 70/56 |
| 6,058,745 | A | * | 5/2000 | Sanchez | 70/56 |

(Continued)

*Primary Examiner* — Christopher Boswell

(74) *Attorney, Agent, or Firm* — Joseph S. Heino; Patrick M. Bergin

(57) ABSTRACT

A hasp seal lock assembly includes a base member that is attached via a hinge to a cover member. The cover member, when rotated such that the cover member engages the base member, is functionally adapted to overlay a latch and seal. The base member and the cover member each have a plurality of apertures defined in adjacent side walls that allow the horizontal latch arm to extend through the assembly. The base member and the cover member also include a second plurality of cooperating apertures whereby the base member and the cover member may be locked together by use of a padlock. In a first preferred embodiment, each cover side wall includes a tab and tab-receiving apertures are defined within the base member. The tabs require that the cover be lifted vertically prior to rotation of the cover member about the base member.

15 Claims, 23 Drawing Sheets

(56) References Cited

U.S. PATENT DOCUMENTS

| | | | | |
|---|---|---|---|---|
| 6,481,829 | B1 * | 11/2002 | Bailey et al. | 347/49 |
| 6,848,284 | B2 * | 2/2005 | Chen | 70/56 |
| 6,928,843 | B1 * | 8/2005 | Pirnie | 70/54 |
| 7,278,284 | B1 * | 10/2007 | James | 70/56 |
| D690,274 | S * | 9/2013 | Greaney | D13/156 |
| 8,596,100 | B1 * | 12/2013 | Crispell | 70/63 |
| 2008/0223601 | A1 * | 9/2008 | Johnson | 174/67 |

* cited by examiner

HASP SEAL LOCK ASSEMBLY

This application claims the benefit and priority of U.S. Provisional Patent Application No. 61/333,810 filed May 12, 2010.

FIELD OF THE INVENTION

The present invention relates generally to locks and to other security devices that use locks and locking mechanisms. More specifically, it relates to a lock assembly that is used to secure the latch to the door of a truck storage compartment, or to secure other similar latches that are used for other purposes. It also relates to a lock assembly that is used to protect security seals used with such latches, including strap style seals, wire style seals and bolt style seals. It also relates to such a lock assembly that is unitary in construction such that the assembly is easy to use and eliminates the risk of loss of component parts.

BACKGROUND OF THE INVENTION

Latches that are used for securing truck storage compartment doors are well known in the art. One particular type of latch supports and secures a horizontal bar by means of two connected structures. One structure is a first hasp portion, which is a generally J-shaped holder, and the other is a second hasp portion, which is a generally L-shaped drop-down or hanging latch member. The L-shaped latch member is configured to be rotatably secured to the back portion of the J-shaped holder. The structures are provided with complementary apertures through which the generally U-shaped shackle of a conventional padlock can be inserted such that the two structures can be locked together. Another common, but more problematic, use of the apertures is that they are often used to attach a security seal of some sort through the latch hasp portions after the truck storage compartment has been loaded with product. The security seal insures that the storage compartment has not been accessed via the door of the truck storage compartment. If this security seal is damaged in any way prior to the cargo arriving at its destination, or if the security seal is missing altogether, the cargo compartment contents may be considered "suspect" and the load may not be accepted.

SUMMARY OF THE INVENTION

In the view of these inventors, what is needed is a unitary, one-piece device or assembly for securely and inexpensively protecting the latch and latch hasp portions of a cargo or truck storage compartment door latch mechanism, and any security seal attached to the latch and its hasp portions. The present invention provides such an assembly that, when used properly, helps to prevent the latch, and the security seal that may be used with the latch, from being compromised at all times during which the assembly is used. The present invention provides for a unique locking assembly having a number of components that form such a unitary device. The assembly includes a base member that is attached via a hinge to a cover member. The base member and the cover member, when rotated such that the cover member engages the base member, are functionally adapted to overlay the latch thereby preventing tampering of the latch and the security seal. The base member and/or the cover member each have a first plurality of cooperating cut-outs defined in adjacent side walls that allow the horizontal bar to extend through the cut-outs. In that way, the base member and the cover member may be "clamped" down over the latch. The base member and the cover member also include a second plurality of cooperating apertures whereby the base member and the cover member may be locked together by use of a padlock. In a first preferred embodiment, the cover side walls also include a tab and tab-receiving apertures are defined within the base member. The tabs require that the cover be lifted vertically prior to rotation of the cover member about the base member. Other alternative embodiments are provided in this disclosure, all of which are contemplated to be within the scope of the present invention.

The foregoing and other features of the hasp seal lock assembly of the present invention will be apparent from the detailed description that follows.

DETAILED DESCRIPTION OF THE INVENTION

Figure 1:
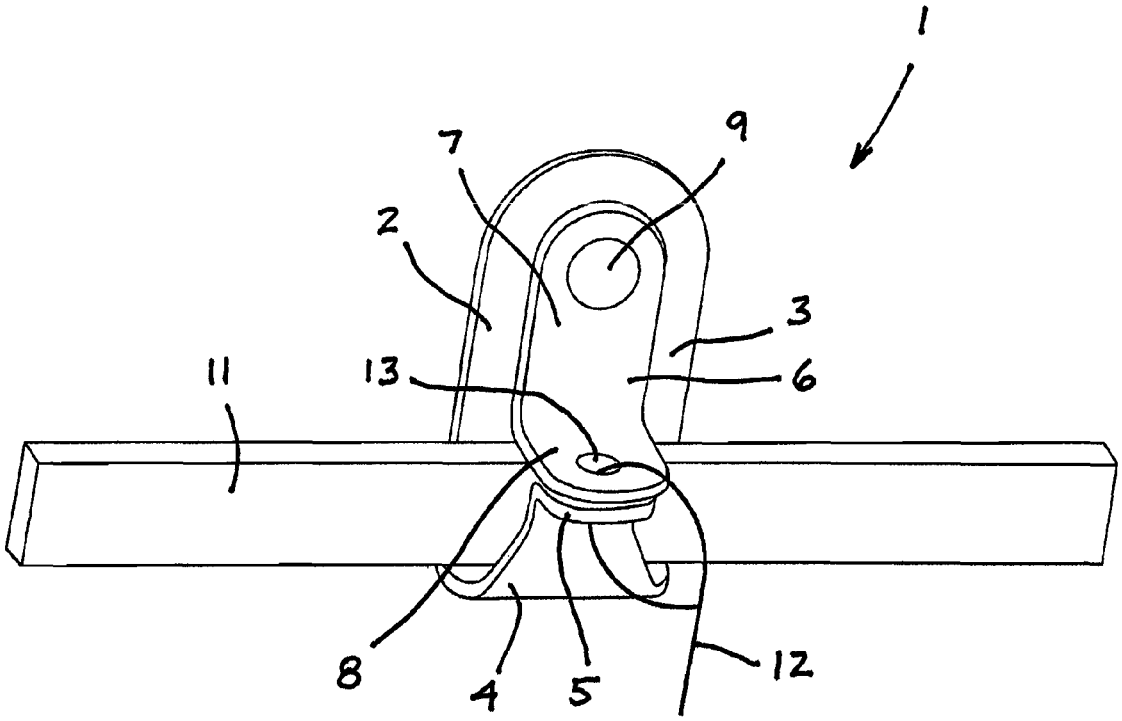
FIG. 1 is a perspective view of a latch and hasp seal mechanism known in the art.

Referring now to the drawings in detail, where like-numbered elements represent the same structure throughout, FIG.

1 is a perspective view showing a conventional latching or locking mechanism, generally identified 1, that is known in the art. The mechanism 1 is configured to be attached to the outer surface of a door of a cargo container or trailer (not shown) and comprises a generally J-shaped first hasp portion 2 and a generally L-shaped "drop-down" second hasp portion 6. The J-shaped first hasp portion 2 comprises a back 3 that is secured to the surface. The J-shaped first hasp portion 2 further comprises a lower portion 4 and an outwardly-projecting lower lip 5. The lip 5 has an aperture (not shown) in it. The L-shaped second hasp portion 6 is configured to be rotatably secured to the back 3 of the J-shaped first hasp portion 2 via a fastener 9. The L-shaped second hasp portion 6 comprises back 7 and an outwardly-projecting lip 8 having an aperture 13 in it. The apertures of the hasp portions 2, 6 are used to thread a hasp security seal 12 through them when a latch arm 11 is positioned between the hasp portions 2, 6 as shown. It is to be understood that the hasp security seal 12 could be a strap style seal, a wire style seal or a bolt style seal of the type known in the art.

Figure 3:
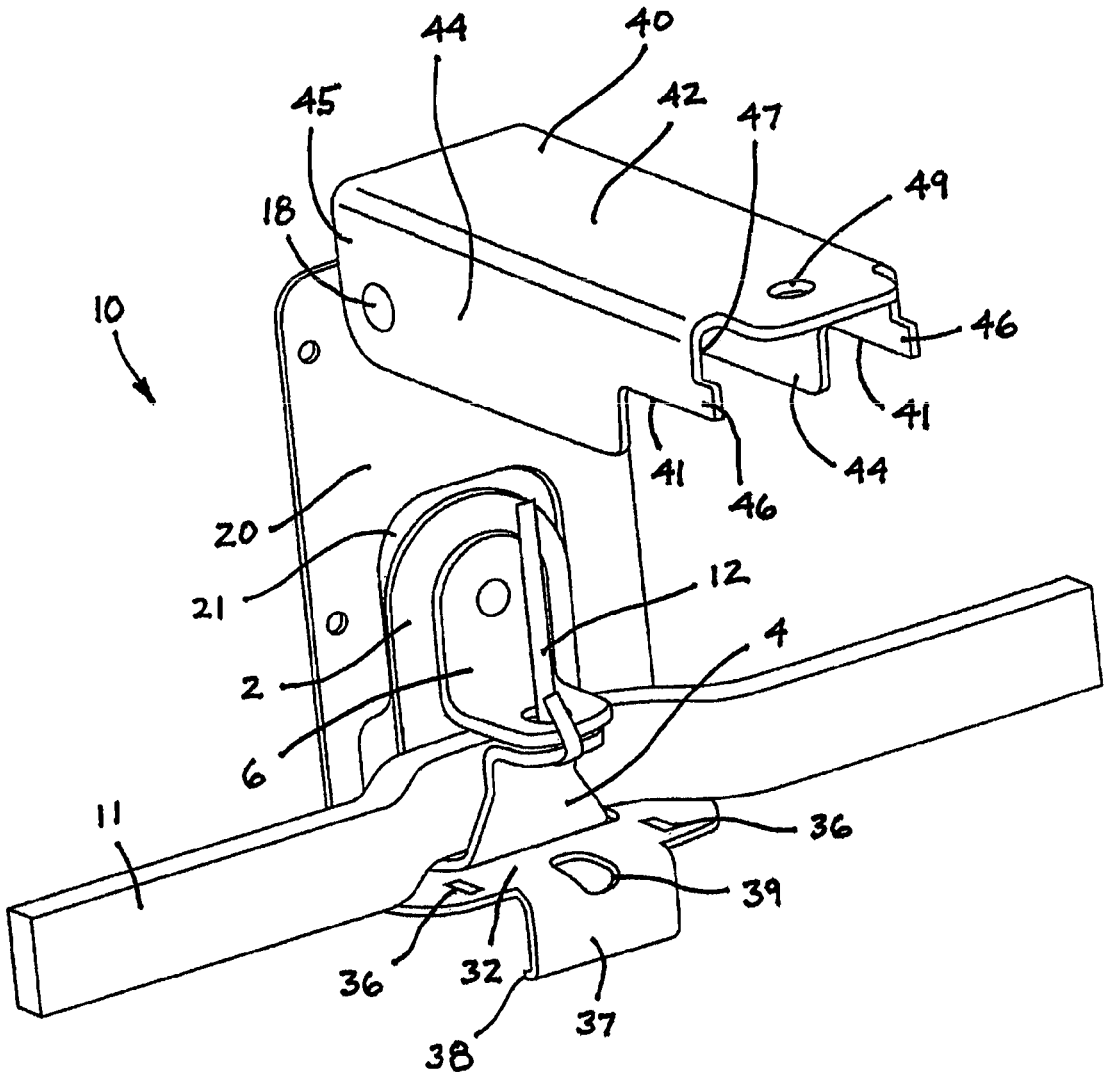
FIG. 3 is a perspective view of a first embodiment of the hasp seal lock assembly of the present invention as it would be used with the latch and hasp seal mechanism illustrated in FIG. 1, the cover member of the assembly being shown in the "open" position.
Figure 5:
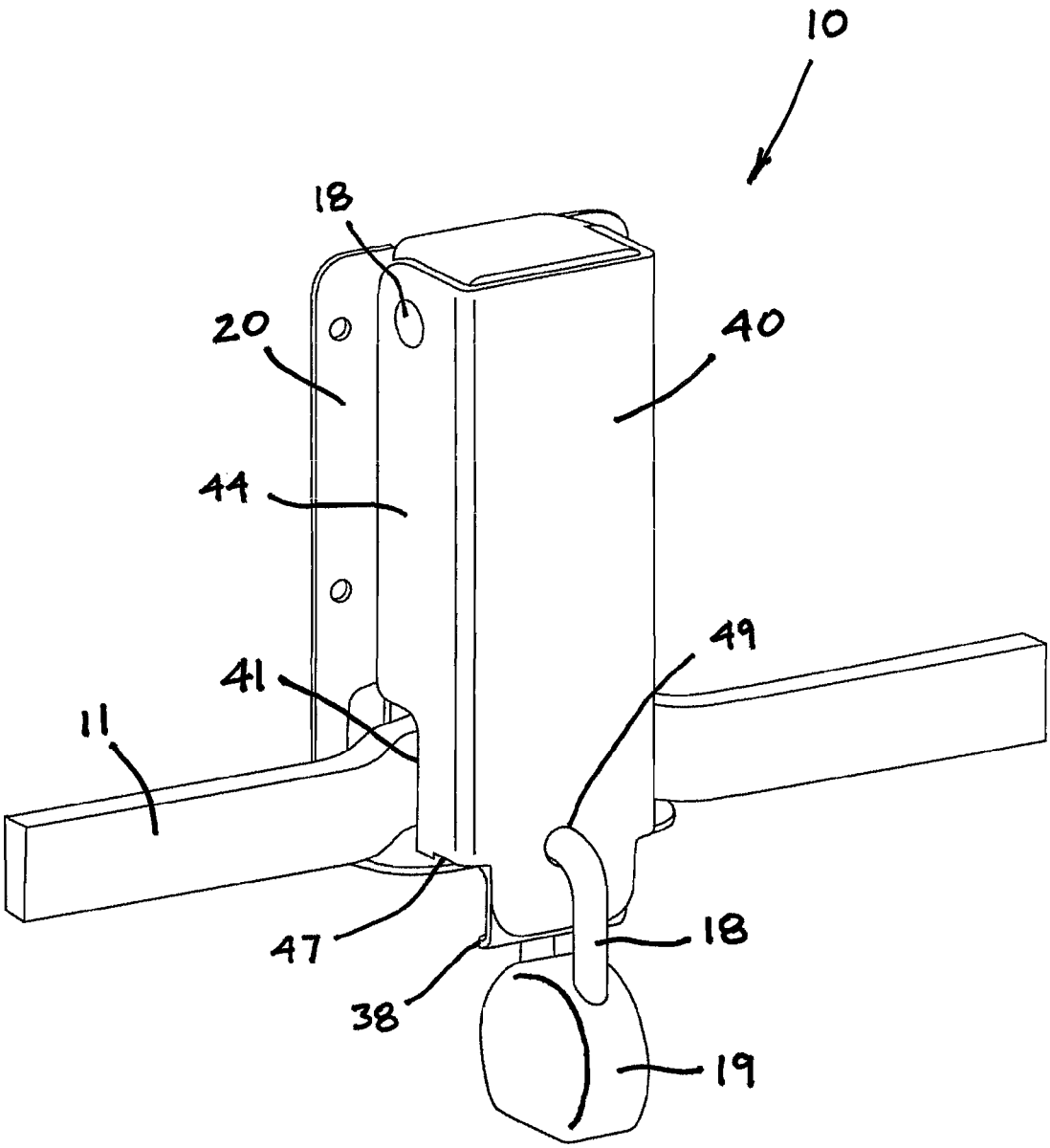
FIG. 5 is a view similar to FIG. 4 but showing the cover member being lowered and locked to the base member.

FIGS. 3 and 5 illustrate a first preferred embodiment of a hasp seal lock assembly, generally identified 10, that is configured in accordance with the present invention. FIG. 3 illustrates the assembly 10 in a fully "open" position whereas FIG. 5 shows it in a fully "closed" position. This first embodiment comprises a base member 20 and a cover member 40, the base member 20 being preferably permanently attached to the object to be locked, such as the cargo door of a trailer or shipping container. It should be noted, however, that the lock assembly 10 is designed by the inventors to be either permanently or not permanently attached to such door. This is because, when the assembly 10 is closed and locked onto the hasp latching or locking mechanism 1, the latch arm or handle 11 will hold each in place. When placed together as shown in FIG. 5, the base member 20 and the cover member 40 form a generally rectangular box-like structure that prevents access to the hasp portions 2, 6 of the latch mechanism 1 and to the hasp security seal 12 placed through the hasp portions 2, 6.

Figure 2:
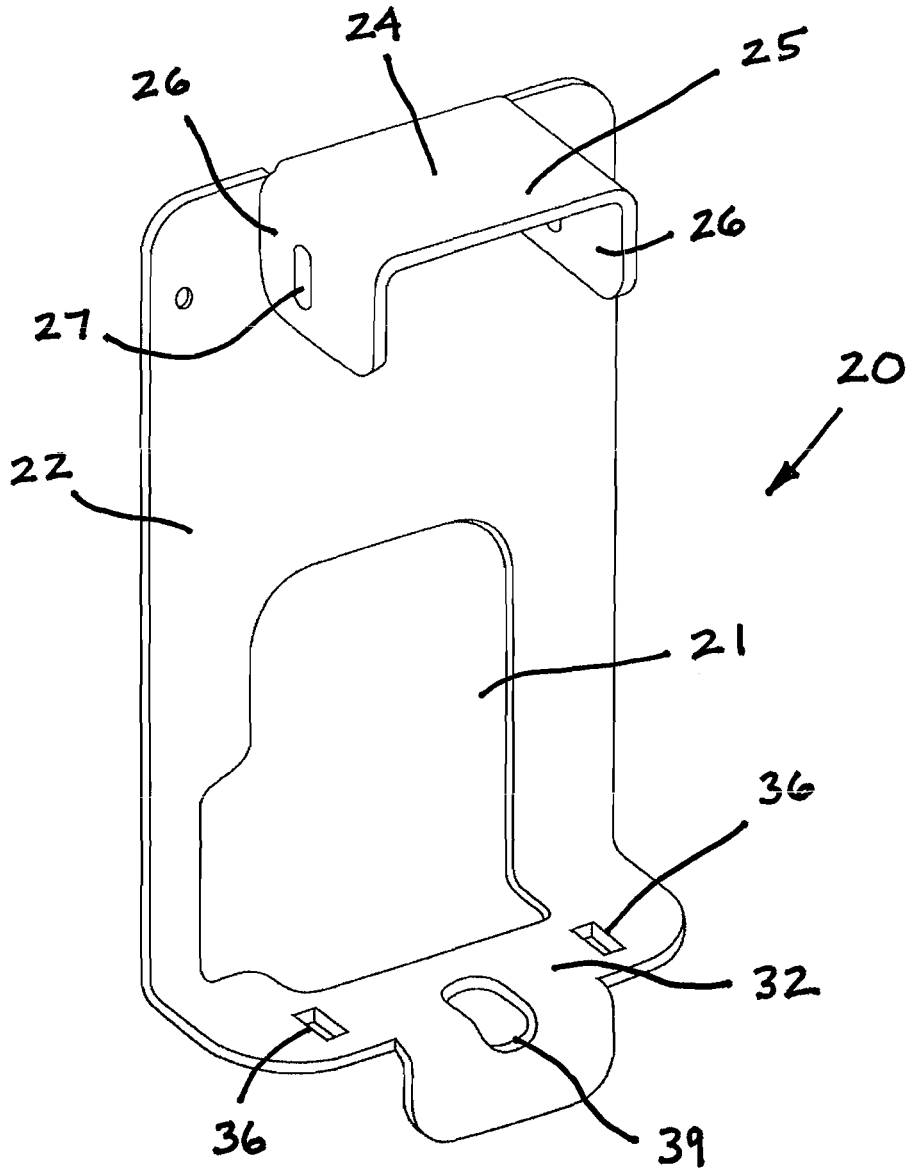
FIG. 2 is a perspective view of the base member of the hasp seal lock assembly of the present invention.

Referring to FIG. 2, it will be seen that the base member 20 comprises a flat planar back portion 22, an outwardly extending and inverted generally U-shaped top portion 24 and an outwardly extending bottom portion 32. An opening 21 is formed within the back portion 22 to allow the assembly 10 to be mounted atop the latch and hasp seal mechanism 1 shown in FIG. 1. Referring again to FIG. 2, it will be seen that the U-shaped top portion 24 of the base member 20 includes a flat 25 and a pair of opposing and downwardly extending legs 26, one leg 26 disposed to each side of the flat 25. Each downwardly extending leg 26 further comprises an elongated slot-like and vertically-disposed aperture 27 through which a fastener, such as connecting nuts and bolts, rivets or even a single pin 18, may be received. See also FIG. 3. The fastener 18 is inserted generally horizontally through circular apertures (not shown) that are defined near the upper edge 45 of the rearwardly extending side walls 44 of the cover member 40. This structure provides a means for rotatably securing the cover member 40 to the base member 20. That is, the cover member 40 can rotate upwardly and downwardly about the fastener 18 relative to the top portion 24 of the base member 20. The fastener 18 may be flattened at each end to provide security for the assembly 10 once the fastener 18 is inserted.

The vertically elongated slot-like apertures 27 also provide part of the means for locating the cover member 40 relative to the base member 20 since they allow the cover member 40 to be slightly elevated vertically relative to the base member 20. See FIG. 4. That is, the cover member 40 and fastener 18 can be elevated slightly vertically, the fastener 18 moving vertically within the slot-like apertures 27 defined in the downwardly extending legs 26 of the top portion 24 of the base member 20. The significance of this functionality will be discussed further in this detailed description.

Figure 4:
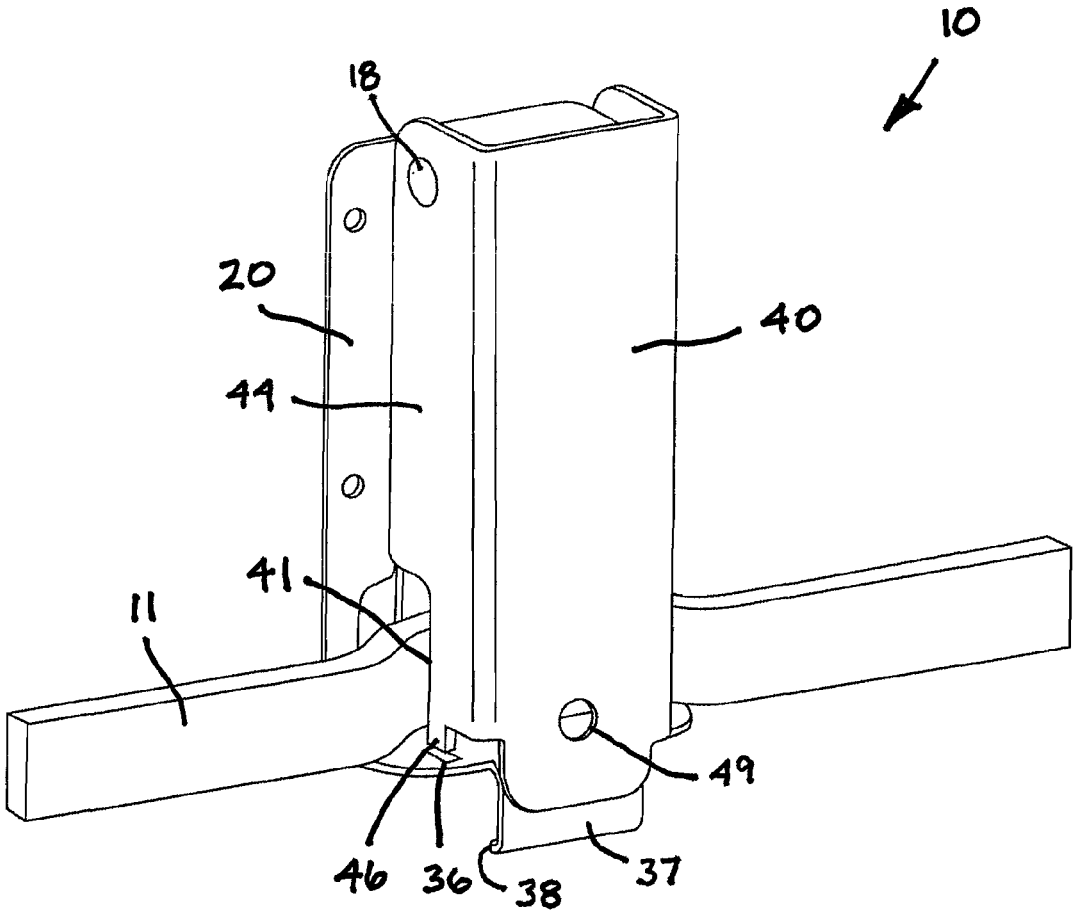
FIG. 4 is a view similar to FIG. 3 and showing cover member of the lock assembly in the "closed" position, but showing the cover member being slightly elevated from the base member.

In addition to the structure mentioned above, the cover member 40 further comprises a front wall 42 and a pair of tabs 46, one extending downwardly from the lower edge 47 of each of two side walls 44. A latch arm opening 41 is also defined at the lower edge 47 of each side wall 44, the opening 41 allowing a portion of the latch arm 11 to extend through the assembly 10. See FIG. 3. The bottom portion 32 of the base member 20 comprises a forwardly extending flat 32 having a pair of slot-like apertures 36 defined in it, each aperture 36 being configured to receive a tab 46 of the cover member 40 within it. The use of the tabs 46 in the assembly 10 is important because it requires that the cover member 40 be lifted slightly vertically so that the tabs 46 can first disengage from the apertures 36, as shown in FIG. 4, after which the cover member 40 can then be rotated and fully opened. A lock-receiving aperture 39 is disposed centrally within the bottom portion 32 of the base member 20 as well. This aperture 39 aligns with a similar lock-receiving aperture 49 that is defined in the bottom 47 of the face portion 42 of the cover member 40. These apertures 39, 49 allow the cover member 40 and base member 20 to be locked together using the shackle 18 of a conventional padlock 19, as is shown in FIG. 5.

An added feature to the cover member tabs 46 is that a curved radius (not shown) may be formed along the rearward side of each tab 46, which would be included to assist the user in locating and placing the tabs 46 in the slot-like apertures 36 of the base member 20. This feature will be identified more particularly with respect to the next embodiment of the assembly 10.

Lastly, it is to be noted that the bottom portion 32 of the base member 20 further includes a downwardly extending portion 37 having a rearwardly extending or projecting lip 38. See FIGS. 3 and 4. The purpose of the downwardly extending portion 37 and lip 38 is to take up some of the "slack" of the lock shackle 18 in the padlock 19. See FIG. 5, in particular. This essentially prevents the padlock 19 from being moved laterally which could otherwise allow the cover 40 to be lifted and the tabs 46 to be disengaged from the apertures 36 of the bottom portion 32 of the base member 20. Without the lip 38, there could be partial access to the latch mechanism 1 and the seal 12, which is also not desirable.

Figure 6:
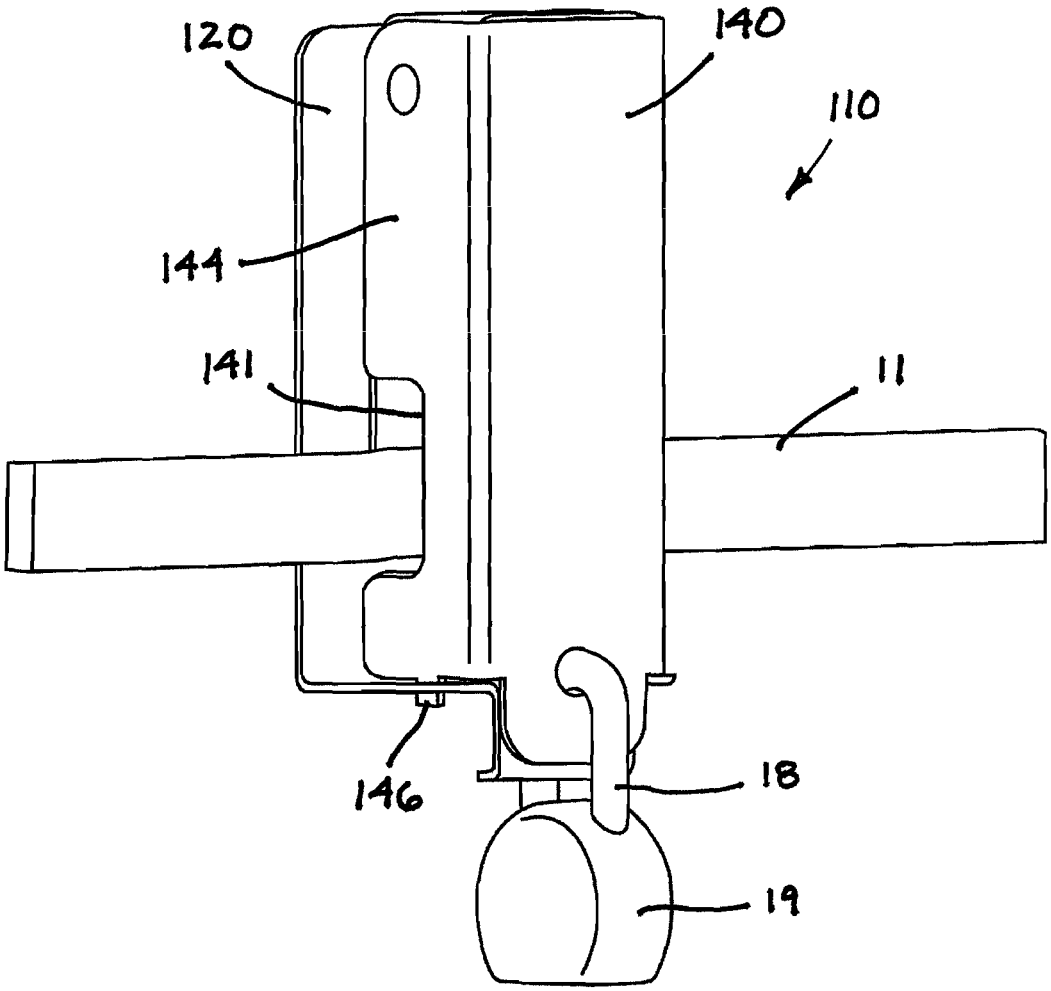
FIG. 6 is a perspective view of a first alternative embodiment of the assembly, such view being similar to that of FIG. 5.

A first alternative embodiment of the assembly 10 of the present invention requires a slightly different configuration for a cover member 40 when the assembly 10 is to be used with a bolt style seal, as opposed to a strap or wire style seal. For example, and referring now to FIG. 6, it shows a first alternative embodiment of the assembly, generally identified 110, that is constructed in accordance with the present invention. Specifically, this assembly 110 uses essentially the same base member 120 as the assembly 10 discussed above, with one exception, which is that the cover member 140 is configured slightly differently. In particular, the cover member 140 is configured so as to accommodate the use of a security seal in the form of a bolt style seal 112 as well as a security seal in the form of a strap style seal 12 as previously discussed. See FIGS. 8A and 8B.

The bolt style seal 112 requires that the cover member 140 be modified slightly by providing for a latch arm opening 141 that is disposed further upwardly along the side walls 144 of the cover member 140. The base 120 need not be modified as the base aperture 121 allows for alternative positioning of the assembly 110 relative to the latch mechanism 1. This provides for greater clearance between the bolt style seal 112 and the bottom portion 132 of the back member 120. See FIG. 8B. In all other respects, the cover 140 of the second embodiment is identical to that of the cover 40 of the first embodiment. Its functionality is the same as well.

Figure 7:
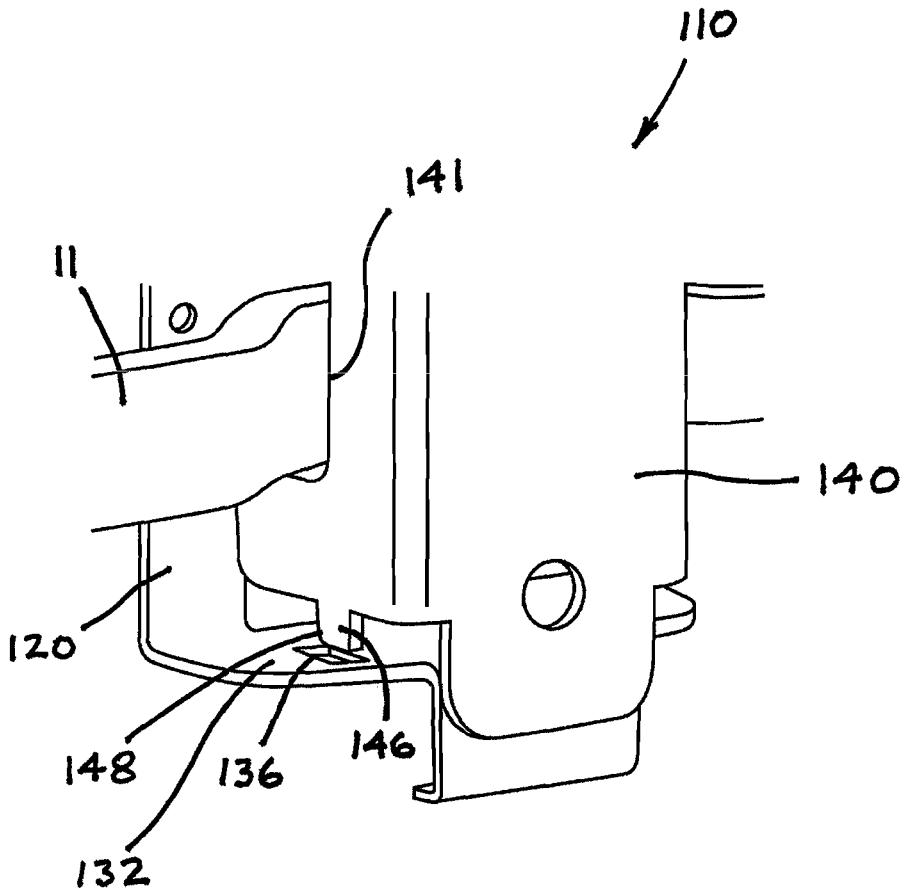
FIG. 7 is an enlarged perspective view of a portion of the embodiment illustrated in FIG. 6, but showing the cover member being slightly elevated from the base member.

FIG. 7 also shows a design element that can be used in both embodiments of the assembly 10, 110 mentioned here. Specifically, it will be seen in that drawing that the tab 146 has a rounded rear edge 148 which facilitates the ability of the tab 146 to seat itself within the aperture 136 of the bottom portion 132 of the base 120. Though not shown specifically with respect to the preferred embodiment, this configuration would work with that assembly 10 as well and is within the scope of the present invention.

Figure 9:
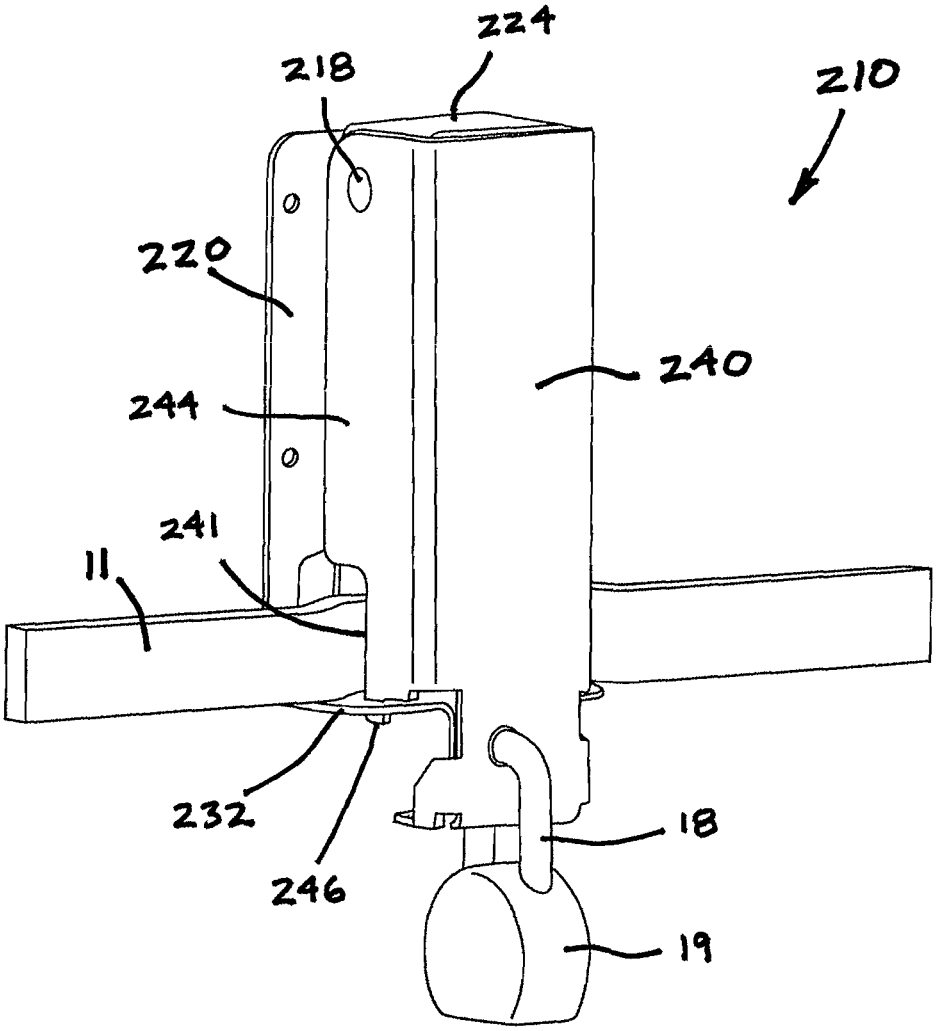
FIG. 9 is a perspective view of a second alternative embodiment of the lock assembly of the present invention, such view being similar to that of FIGS. 5 and 6.
Figure 10:
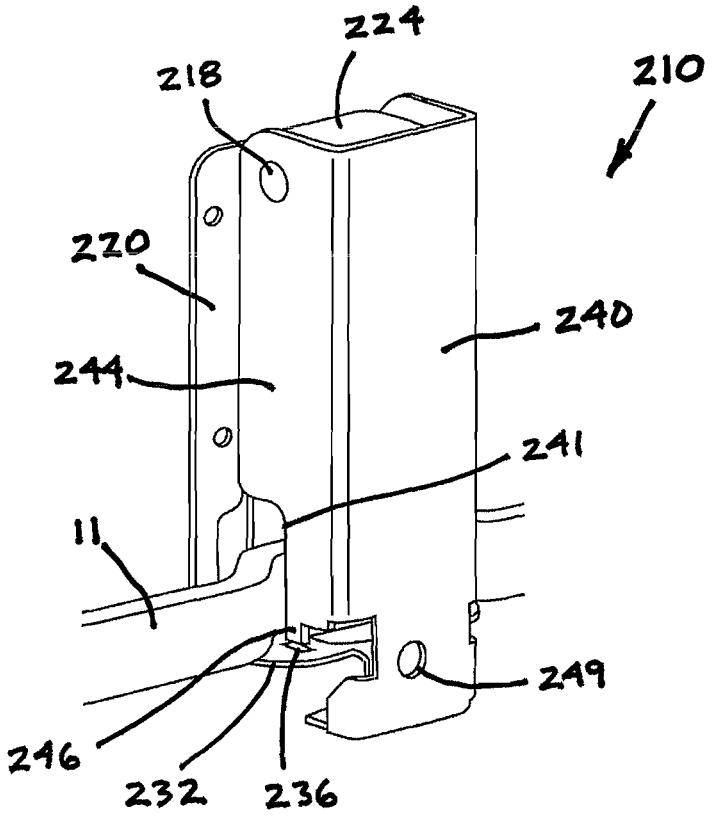
FIG. 10 is a perspective view of the second alternative embodiment of the lock assembly illustrated in FIG. 9, the cover member of the assembly being shown in a slightly elevated position.

A second alternative embodiment of the assembly 10 of the present invention requires yet another slightly different configuration for a cover member 240 when the assembly 10 is used with yet another type of lock, but which can be used with any one of a bolt style seal 112, a strap style seal or a wire style seal 12 as previously described. Specifically, and referring now to FIGS. 9 and 10, they show the second alternative embodiment of the assembly, generally identified 210, that is constructed in accordance with the present invention. Specifically, the assembly 210 uses a slightly modified base member 220 as compared to that used with the assemblies 10, 110 discussed above. The base member 220 has a bottom portion 232 that has a rearward opening 233 defined in it, the opening 233 allowing the insertion of the bolt style seal 112 from beneath the base member 220. See FIGS. 11A through 11D. The padlock aperture 239 is located further down the bottom portion 232 of the base member 220, which aligns with the aperture 249 of the cover member 240 when the cover member 240 is closed. This configuration also allows the use of alternative padlock formats (not shown) as well as allowing alternative seals to be utilized without interfering with the inserted padlock.

The cover member 240 in this embodiment accommodates the use of a security seal in the form of the strap style seal 12 and a security seal in the form of a bolt style seal 112. It will also be appreciated that each side 244 of the cover member 240 could be separately attached, and rotatably so, about the adjacent and downwardly extending leg 226 of the top portion 224 of the base member 220 by means of an individual fastener 218 secured to each side of the cover member 240, as is shown in FIG. 11C. The use of dual fasteners 218 still allows for movement of the cover member 240 slightly vertically relative to the base member 220 to allow for engagement of the cover member tabs 246 with the apertures 236 of the base member bottom portion 232. Each side wall 244 includes a latch opening 241, the opening 241 allowing a portion of the latch arm 11 to extend through the assembly 240.

Figure 8A:
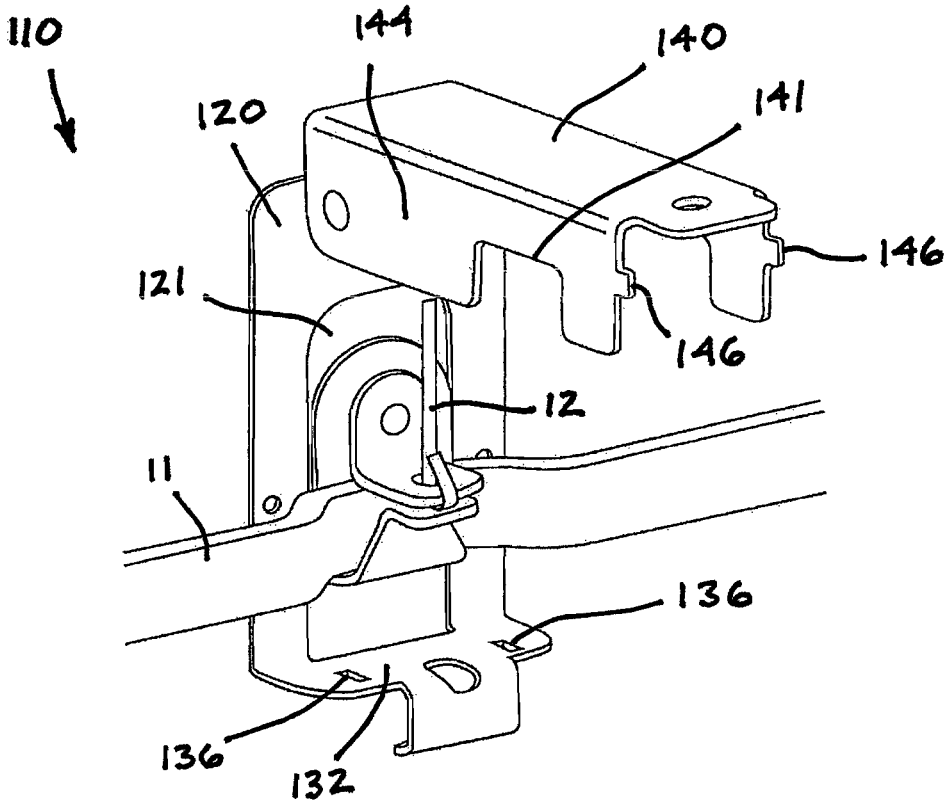
FIGS. 8A and 8B are views similar to those shown in FIG. 3, but illustrating different types of seals used with the first alternative embodiment.
Figure 8B:
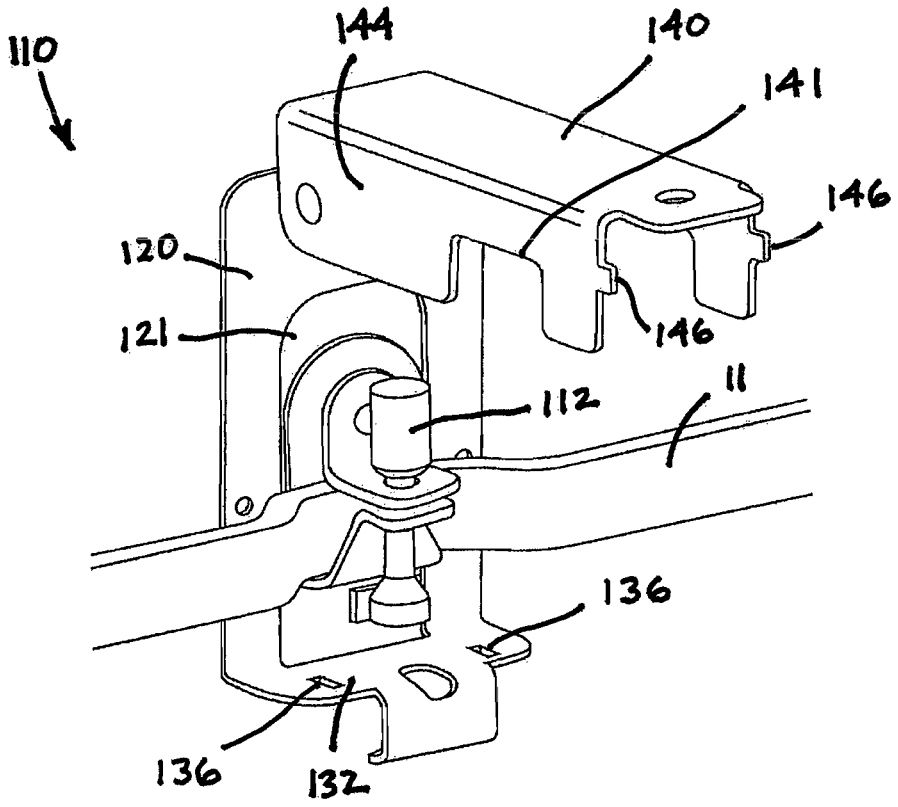
Figure 11A:
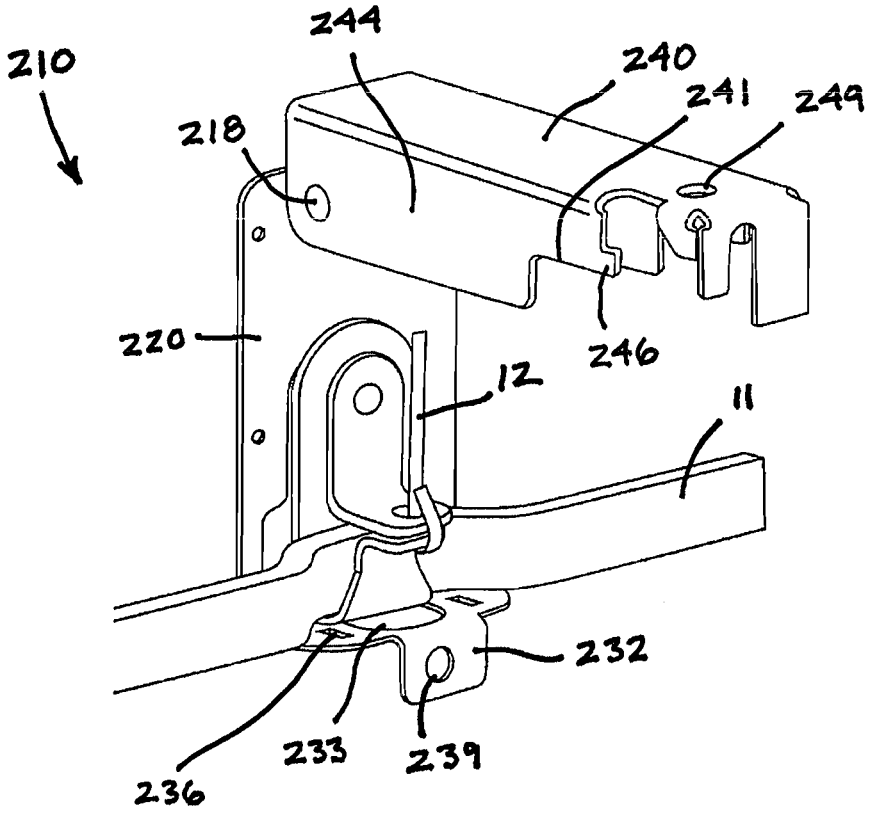
FIGS. 11A and 11B are views of the second embodiment as different seal types would be used with the second alternative embodiment shown in FIG. 9.
Figure 11B:
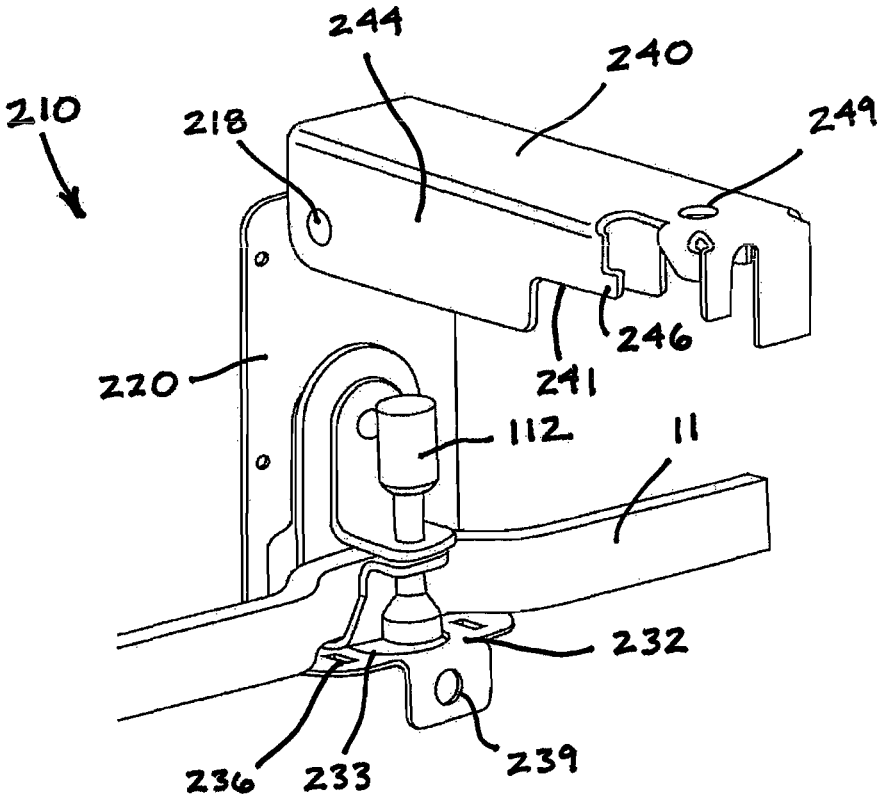
Figure 11C:
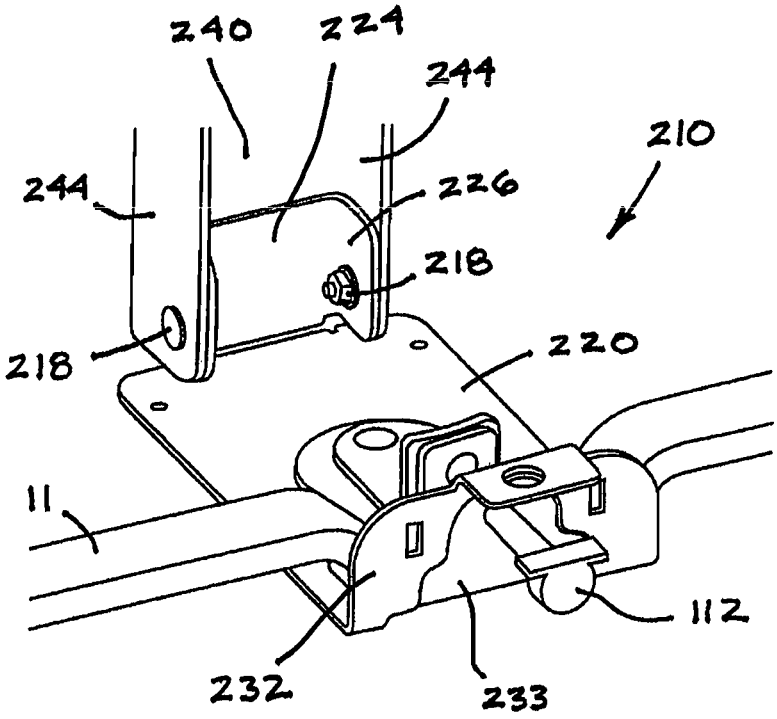
FIGS. 11C and 11D are views from the bottom of the assembly shown in FIG. 9.
Figure 11D:
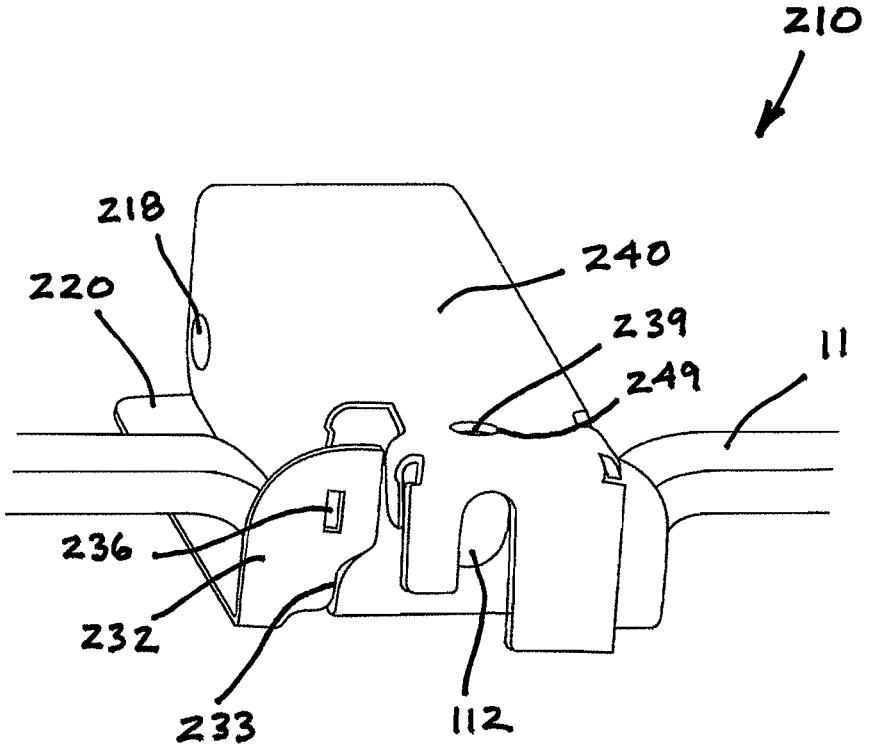

It should also be mentioned here that the cover members 40, 140, 240 of any of the foregoing embodiments could include the use of a spring or other resilient memory device (not shown) so as to bias the cover members 40, 140, 240 in an "open" position, such as that illustrated in FIGS. 3, 8A and 11A, respectively, when the assemblies 10, 110, 210 are in their un-locked position.

Figure 12A:
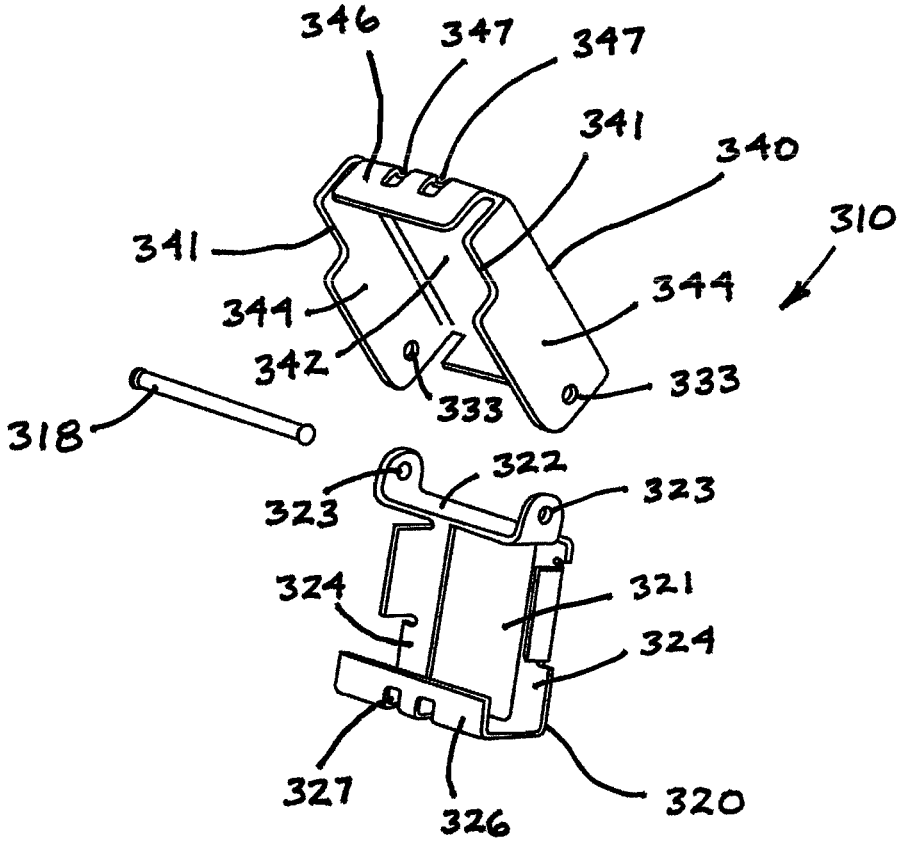
FIGS. 12A and 12B are exploded and assembled views, respectively, of a third alternative embodiment of the assembly of the present invention.
Figure 12B:
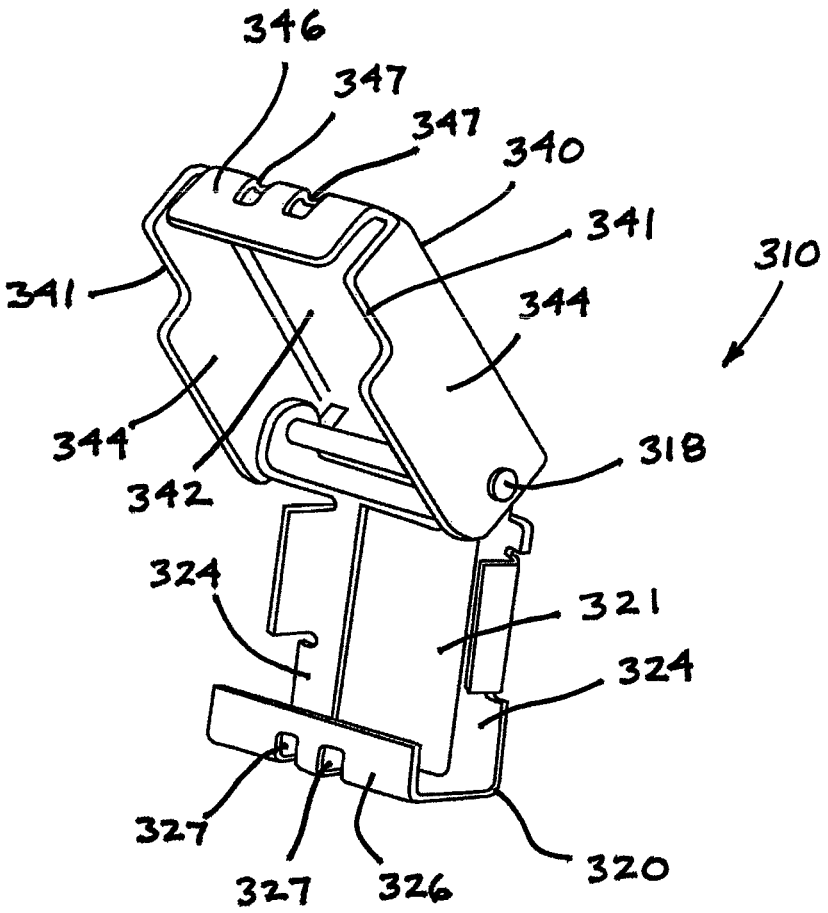

FIGS. 12A and 12B illustrate yet another preferred embodiment of a lock assembly, generally identified 310, that comprises a cover member 340 and a similarly shaped, but slightly smaller, base member 320. When placed together as shown in FIG. 12B, the cover member 340 and the base member 320 similarly form a generally rectangular box-like structure. The precise shape is not a limitation of the present invention as long as the assembly includes a base member 320 and a cover member 340 that, together, are capable of forming a hollow structure that functions in the intended fashion as is disclosed and described herein. In this embodiment, the base member 320 comprises a frame-like structure having a top portion 322, opposing side portions 324 and a bottom portion 326. These portions 322, 324 and 326 frame an opening 321 in the base member 320, which opening 321 is configured to receive a portion of the latch mechanism 1 shown in FIG. 1. At the top portion 322 of the frame, two opposing apertures 323 are defined for receiving at least one fastener, which is a single pin 318 as shown. It is to be understood that two fasteners could be used, one to either side of the assembly 310, to secure the cover member 340 to the base 320, much like those shown in FIG. 11C. The pin 318 is inserted through like apertures 333 that are defined within the side walls 344 of the cover member 340 such that the cover member 340 rotates upwardly and downwardly about the pin 318. The pin 318 is riveted at each end for security. The "pivot point" of this embodiment, as with others, is intended to be tamper proof or tamper resistant. It is also to be understood that the present invention is not limited to use of a riveted pin 318 in this or in any of the other alternative embodiments disclosed herein. Again, other fasteners may be used for the same purpose without deviating from the scope of the present invention.

As shown, the cover member 340 comprises a face 342 (see FIG. 13B, in particular), a pair of opposing side portions 344 and a bottom portion 346. The side portions 344 of the cover member 340 have openings 341 defined in them which allow a portion of the latch mechanism 1 to pass through the cover member 340. See FIGS. 13A and 13B. The bottom portion 346 of the cover member 340 has apertures 347 in it as well which correspond to like apertures 327 in the bottom portion 326 of the base member 320. This allows the U-shaped shackle of a padlock (not shown) to pass through those complementary apertures 327, 347 and to allow the cover member 340 to be locked to the base member 320 of the lock assembly 310. This configuration protects the latch mechanism 1 and the seal (also not shown) against tampering.

Figure 14A:
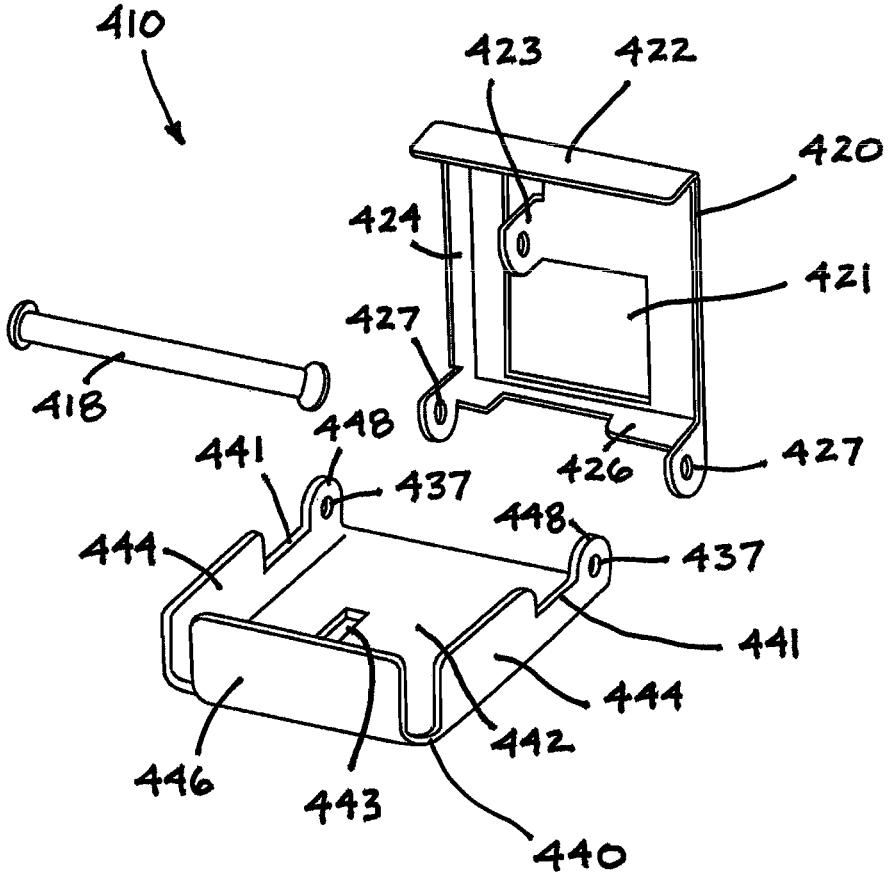
FIGS. 14A and 14B are exploded and assembled views, respectively, of a fourth alternative embodiment of the assembly of the present invention.
Figure 14B:
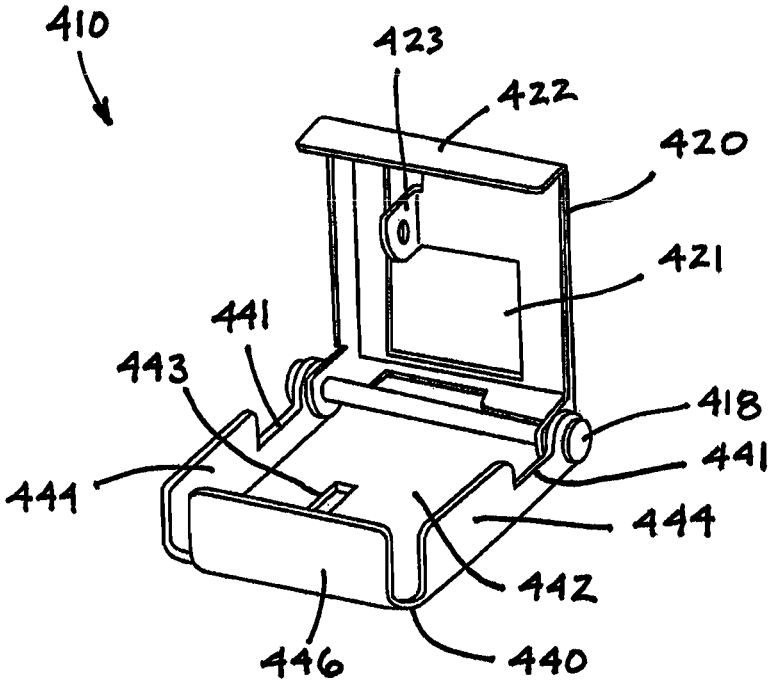

FIGS. 14A and 14B illustrate yet another preferred embodiment of a lock assembly, generally identified 410, that is likewise configured in accordance with the present invention. This embodiment also comprises a cover member 440 and a similarly shaped, but slightly smaller, base member 420. When attached together as shown in FIG. 14B, the cover member 440 and the base member 420 form a generally rectangular box-like structure, as was the case with the prior embodiments. The precise shape is not a limitation of the present invention as long as the assembly includes a base member 420 and a cover member 440 that, together, are capable of forming a hollow structure that functions to cover and protect a portion of the latch mechanism 1 as is described above. In this embodiment, the base member 420 comprises a frame having a top portion 422, opposing side portions 424 and a bottom portion 426. The top portion 422 of the base member 420 frame further includes a forwardly extending staple 423. The frame surrounds a back opening 421, which opening 421 is configured to receive a portion of the latch mechanism 1. See FIGS. 15A and 15B. At the bottom portion 426 of the base member 420, two opposing apertures 427 are defined for receiving a pin 418. The pin 418 is inserted generally horizontally through like apertures 437 that are defined within the cover member 440 such that the cover member 440 rotates upwardly and downwardly about the pin 418. The pin 418 is riveted at each end to provide security for the assembly 410. The cover member 440 further comprises a face 442 and a slot 443 defined within the face 442 through which the staple 423 of the base member 420 extends. This structure allows the cover member 440 and base member 420 to be locked together.

Figure 15A:
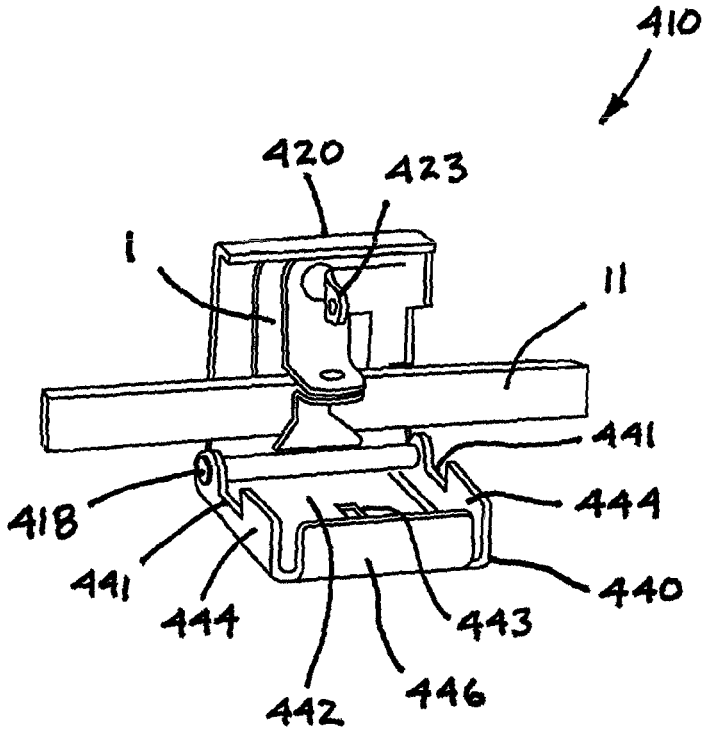
FIGS. 15A and 15B illustrate the fourth alternative embodiment of the assembly when used with a latch and hasp seal mechanism of the type shown in FIG. 1.
Figure 15B:
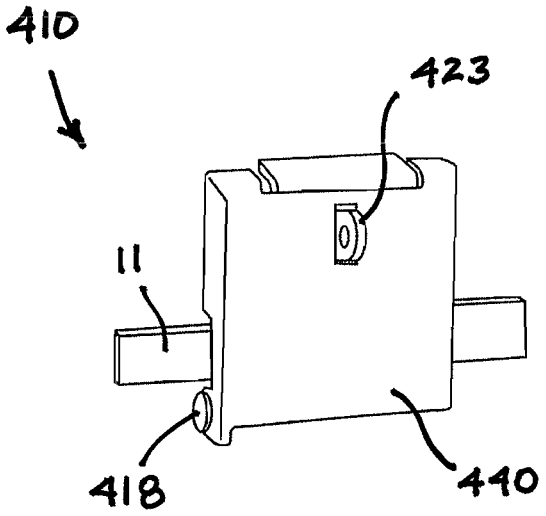

As shown, the cover member 440 also comprises a pair of opposing side portions 444, each having a bottom portion 448, and a top portion 446. The cover side portions 444 have openings 441 defined in them which allow a portion of the latch mechanism 1 to pass through the cover member 440. The bottom portion 448 of each side portion 444 has an aperture 437 in it which correspond to a like aperture 427 in the bottom portion 426 of the base member 420 for receiving the pin 418. FIGS. 15A through 15B illustrate how the cover member 440 and the base member 420 of the lock assembly 410 in this third embodiment engage the latch mechanism 1.

It should be mentioned here that the assemblies 10, 110, 210, 310, 410 are designed by the inventors to be either permanently or not permanently attached to a trailer door. That is, once the assembly 10, 110, 210, 310, 410 is closed and locked onto the hasp latching or locking mechanism 1, the latch arm or handle 11 will hold each in place. While permanent attachment is recommended, such is not required since the assemblies 10, 110, 210, 310, 410 will function as designed with either mode of attachment. It should also be mentioned here that the assemblies 10, 110, 210, 310, 410 are functionally adapted to be used with latch arms or handles 11 that are straight or bent inwardly at the point of the latching or locking mechanism 1.

Figure 13A:
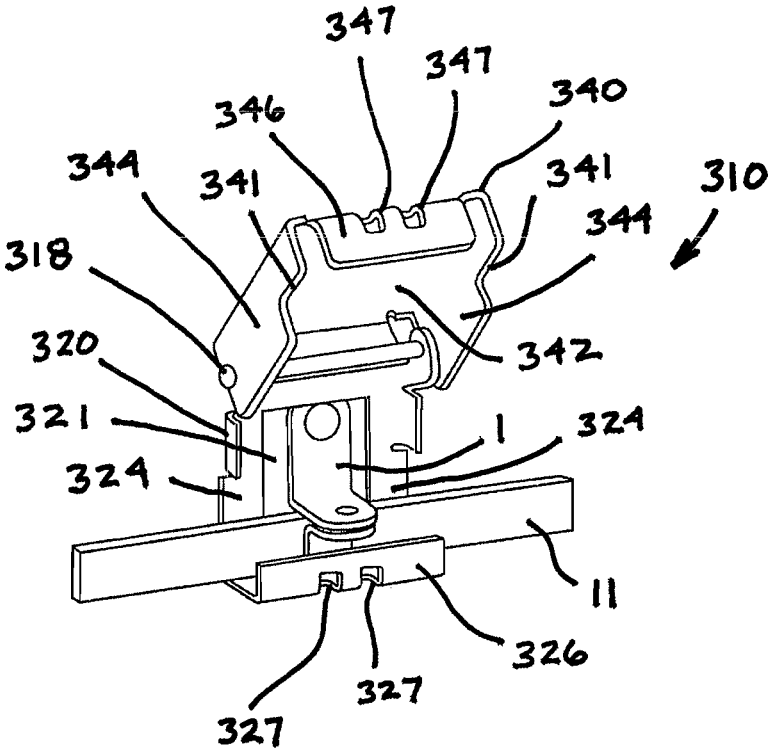
FIGS. 13A and 13B illustrate the third alternative embodiment of the assembly when used with a latch and hasp seal mechanism as shown in FIG. 1.
Figure 13B:
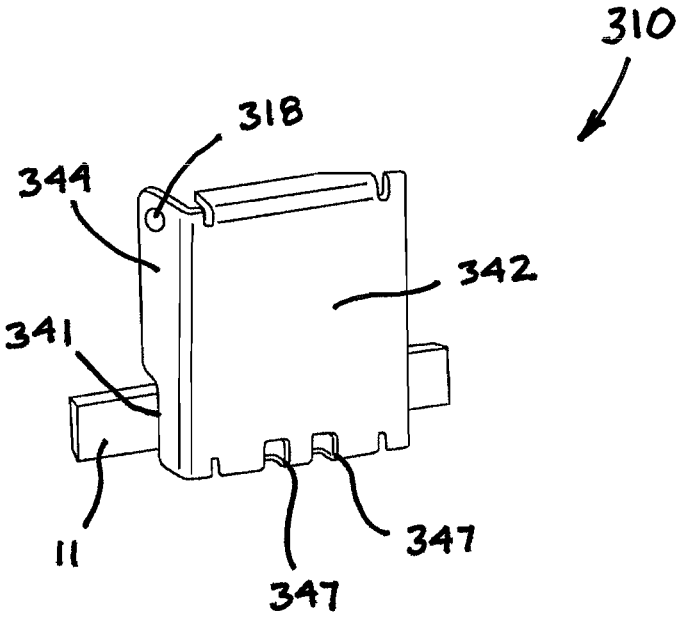

Although previously mentioned earlier in this disclosure, it should be further understood that each of the cover members 340, 440 of the foregoing embodiments could also include the use of a spring or other resilient memory device (not shown) so as to bias the cover members 340, 440 in an "open" position, such as that illustrated in FIGS. 13A and 15A, respectively, when the assemblies 310, 410 are in their un-locked position.

Additional advantages and modifications will readily occur to those skilled in the art. Therefore, the invention in its broader aspects is not limited to the specific details disclosed and described herein. Accordingly, various modifications may be made without departing from the spirit or scope of the general inventive concept.

The details of the invention having been disclosed in accordance with the foregoing, we claim:

1. A unitary hasp seal lock assembly comprising:

a base member, the base member comprising a unitary structure, the base member further comprising a forwardly extending bottom portion having at least one slot defined in the bottom portion of the base member;

a cover member, the cover member comprising a front wall and a pair of substantially vertical opposing side walls extending rearwardly from the front wall, each side wall comprising an opening, and the at least one of the substantially vertical side walls having a downwardly extending tab;

means for rotating the cover downwardly to a first position relative to the base member where the cover overlays the base member and for rotating the cover upwardly to a second position relative to the base member where the cover does not overlay the base member;

means for vertically raising and lowering the cover member relative to the base member;

means for locating the cover member relative to the base member when the cover member is lowered to the first position, the locating means comprising the at least one downwardly extending side wall tab being inserted into the at least one slot of the base member bottom portion; and means for locking the cover member to the base member using a lock having a shackle, the lock being disposed outside of the assembly, when the cover is lowered vertically and located in the second position relative to the base member;

wherein the base member comprises a flat planar back portion, a top portion and a bottom portion, the back portion comprising an opening to allow the assembly to be mounted over a latch and hasp seal mechanism;

wherein the base member further comprises a top portion having a flat and a pair of opposing and downwardly extending legs, each leg comprising an elongated slot-like and vertically-disposed aperture; each side wall of the cover member having an upper edge and a circular aperture defined therein; and the cover member securing means comprises a fastening means that is inserted through the apertures of the base member and the cover member; and wherein the bottom portion flat of the base member comprises a pair of slot-like apertures and wherein the cover member locating means comprises a tab extending downwardly from a lower edge of each of the cover side walls, the tabs being received within the pair of slot-like apertures of the forwardly extending bottom portion flat of the base member.

2. The assembly of claim 1 wherein the cover member locating means comprises each tab having a rounded rear edge.

3. The assembly of claim 2 wherein the cover member side wall openings are disposed at the bottom of the cover member side walls.

4. The assembly of claim 3 wherein the base member further comprises a rearward opening defined in it such that the assembly is mounted atop the latch and hasp seal mechanism.

5. The assembly of claim 2 wherein the cover member side wall openings are disposed at a point above the bottom of the cover member side walls.

6. The assembly of claim 1 wherein the locking means comprises a lock-receiving aperture defined in the bottom portion of the base member and a lock-receiving aperture defined in the bottom of the cover member, the apertures being aligned when the cover member is closed relative to the base member and the apertures being used to receive the shackle of a padlock.

7. The assembly of claim 1 further comprising a spring means for biasing the cover member in an open position relative to the base member.

8. The assembly of claim 1 wherein the cover member must be elevated vertically to disengage the tabs of the cover member locating means from the slot-like apertures of the bottom flat portion of the base member prior to rotation of the cover member about the top portion of the base member.

9. A unitary hasp seal lock assembly for use with a latch and hasp seal mechanism, the mechanism comprising a first hasp portion and a second hasp portion, the hasp portions having aligned apertures such that a security seal can be secured through the hasp portions, and a latch arm, a portion of the latch arm being positioned between the hasp portions, the lock assembly comprising:

a base member, the base member comprising a unitary structure, the base member further comprising a flat planar back portion, a top portion and a bottom portion, the back portion comprising an opening to allow the assembly to be mounted over the latch and hasp seal mechanism, the top portion comprising a substantially horizontal and forwardly extending top portion having a flat and a pair of substantially vertical and downwardly extending members, each downwardly extending member of the top portion comprising a substantially vertical slot, and the bottom portion comprising a substantially horizontal and forwardly extending bottom portion flat;

a cover member, the cover member comprising a front wall and a pair of substantially vertical side walls extending rearwardly from the front wall, each substantially vertical side wall comprising an opening and the substantially vertical side walls each comprising a downwardly extending tab;

means for securing the cover member in a rotatable position relative to the base member;

means for locating the cover member relative to the base member; and means for locking the cover member to the base member using a lock having a shackle, the lock being disposed outside of the assembly;

wherein the base member further comprises a top portion having a flat and a pair of opposing and downwardly extending legs, each leg comprising an elongated slot-like and vertically-disposed aperture; each side wall of the cover member having an upper edge and a circular aperture defined therein; and the cover member securing means comprises a fastening means that is inserted through the apertures of the base member and the cover member; and wherein the bottom portion flat of the base member further comprises a pair of slot-like apertures and wherein the cover member locating means comprises the tab extending downwardly from a lower edge of each of the cover side walls, the tabs being received within the pair of slot-like apertures of the forwardly extending bottom portion flat of the base member.

10. The assembly of claim 9 wherein the cover member locating means further comprises each tab having a rounded rear edge.

11. The assembly of claim 9 wherein the locking means comprises a lock-receiving aperture defined in the bottom portion of the base member and a lock-receiving aperture defined in the bottom of the cover member, the apertures being aligned when the cover member is closed relative to the base member and the apertures being used to receive the shackle of a padlock.

12. The assembly of claim 11 wherein the cover member side wall openings are disposed at the point where the latch arm extends through the cover member when the cover member is in a closed position relative to the base member.

13. The assembly of claim 11 wherein the base member further comprises a rearward opening defined in it for receiving a bolt style seal.

14. The assembly of claim 9 further comprising a spring means for biasing the cover member in an open position relative to the base member.

15. The assembly of claim 9 wherein the cover member must be elevated vertically to disengage the tabs of the cover member locating means from the slot-like apertures of the bottom flat portion of the base member prior to rotation of the cover member about the top portion of the base member.

* * * * *